US007494248B2

(12) United States Patent
Li

(10) Patent No.: US 7,494,248 B2
(45) Date of Patent: Feb. 24, 2009

(54) HEAT-DISSIPATING STRUCTURE FOR LED LAMP

(75) Inventor: Jia-Hao Li, Kao Hsiung Hsien (TW)

(73) Assignee: Jaffe Limited, Tortola (BV)

( * ) Notice: Subject to any disclaimer, the term of this patent is extended or adjusted under 35 U.S.C. 154(b) by 77 days.

(21) Appl. No.: 11/428,824

(22) Filed: Jul. 5, 2006

(65) Prior Publication Data

US 2008/0007954 A1 Jan. 10, 2008

(51) Int. Cl.
*F21V 29/00* (2006.01)

(52) U.S. Cl. ..... 362/294; 362/345; 362/373; 362/800

(58) Field of Classification Search ..... 362/294, 362/96, 264, 373, 345, 580, 547, 800; 165/80.2, 165/80.3, 80.4
See application file for complete search history.

(56) References Cited

U.S. PATENT DOCUMENTS 3,739,234 A * 6/1973 Bylund et al. ..... 257/715
4,419,716 A * 12/1983 Koo ..... 362/96
4,729,076 A * 3/1988 Masami et al. ..... 362/235
5,826,645 A * 10/1998 Meyer et al. ..... 165/104.33
5,852,339 A * 12/1998 Hamilton et al. ..... 313/11
6,191,946 B1 * 2/2001 Yu et al. ..... 361/704
6,382,307 B1 * 5/2002 Wang et al. ..... 165/80.3
6,517,221 B1 * 2/2003 Xie ..... 362/373
6,910,794 B2 * 6/2005 Rice ..... 362/547
7,011,431 B2 * 3/2006 Ono et al. ..... 362/241
7,270,446 B2 * 9/2007 Chang et al. ..... 362/294
2007/0279862 A1 * 12/2007 Li ..... 361/692
2007/0279909 A1 * 12/2007 Li ..... 362/294
2008/0007955 A1 * 1/2008 Li ..... 362/294

* cited by examiner

*Primary Examiner*—Sandra L. O'Shea
*Assistant Examiner*—Gunyoung T. Lee

(57) ABSTRACT

A heat-dissipating structure for a LED lamp includes a heat-dissipating base, a heat-dissipating body and a plurality of heat pipes. The heat-dissipating body has an outer cylinder formed into a hollow cylinder. The inside surface of the outer cylinder is provided with a plurality of accommodating grooves. The condensed ends of the plurality of heat pipes are inserted into the accommodating grooves. The end to be heated of the heat pipe is adhered to the heat-dissipating base. Further, the inside surface and the outside surface of the outer cylinder are formed with a plurality of heat-dissipating fins made by aluminum extrusion, so that the heat pipes are encircled by the heat-dissipating fins. In this way, the heat can be conducted by the plurality of heat pipes so as to increase the total contacting area. Thus, the heat can be rapidly conducted to the outer cylinder. Further, the heat can be rapidly dissipated to the outside by the heat-dissipating fins, thereby to substantially increase the efficiency in the heat dissipation.

9 Claims, 7 Drawing Sheets

HEAT-DISSIPATING STRUCTURE FOR LED LAMP

BACKGROUND OF THE INVENTION

1. Field of the Invention

The present invention relates to a heat-dissipating structure for a LED lamp, and in particular to a heat-dissipating structure capable of performing the heat dissipation of the LED lamp and substantially increasing the efficiency in the heat dissipation.

2. Description of Prior Art

Since light-emitting diodes (LED) are high-intensity, energy-saved and long-life, they are widely used in the illumination of electronic devices or lamps. Further, in order to increase the illuminating range and intensity thereof, a plurality of light-emitting diodes are usually combined to form a LED lamp set. However, with the increase in the number of light-emitting diodes and the subsequent development of high-power light-emitting diodes, the heat generated by the operation of the light-emitting diodes is inevitably increasing. Therefore, it is an important issue for those skilled in this art to provide a heat-dissipating structure for LED lamps.

As shown in FIG. 1 and FIG. 2, the existing heat-dissipating device 10*a* for the LED lamp comprises: a hollow tube 101*a* having an outer wall face and an inner wall face opposite to the outer wall face; a plurality of heat-dissipating fins 102*a* radially arranged on the outer wall face of the hollow tube 101*a* at intervals, a flowing path 13*a* defined between two heat-dissipating fins 102*a*; and a heat pipe 104*a* provided in the hollow tube 101*a* for contacting with the inner wall face. When the LED lamp generates heat, the heat is first conducted to the heat pipe 104*a*, and then conducted to the heat-dissipating fins 102*a* via the heat pipe 104*a*. Finally, the heat is dissipated to the outside via the heat-dissipating fins 102*a*.

However, the above-mentioned heat-dissipating device 10*a* only uses a heat pipe 104*a* to perform the heat dissipation, the heat cannot be rapidly conducted to the heat-dissipating fins 102*a*. Further, the distance from the heat pipe 104*a* to the distal end of the heat-dissipating fin 102*a* is so long that the heat cannot be rapidly dissipated to the outside, which adversely reduces the efficiency in the heat dissipation of the heat-dissipating device 10*a*.

In view of the above, the inventor proposes the present invention to overcome the above problems based on his expert experiences and deliberate researches.

SUMMARY OF THE INVENTION

The present invention is to provide a heat-dissipating structure for a LED lamp, in which the heat can be conducted by a plurality of heat pipes, thereby to increase the contacting area. Thus, the heat can be rapidly conducted to the heat-dissipating body.

The present invention is to provide a heat-dissipating structure for a LED lamp, in which the distance from the heat pipe to the distal end of the heat-dissipating fin is reduced, thereby to rapidly dissipate the heat to the outside. Therefore, the efficiency in the heat dissipation of the whole heat-dissipating structure can be substantially increased.

One characteristic of the present invention lies in that the heat-dissipating structure is constituted of a heat-dissipating base, a heat-dissipating body and a plurality of heat pipes. The heat-dissipating body has an outer cylinder formed into a hollow cylinder. The inside surface of the outer cylinder is integrally provided with a plurality of accommodating grooves made by aluminum extrusion. The condensed ends of the plurality of heat pipes are inserted into the accommodating grooves. The end to be heated of the heat pipe is adhered to the heat-dissipating base. Further, the inside surface and the outside surface of the outer cylinder are formed with a plurality of heat-dissipating fins made by aluminum extrusion, so that the heat pipes are encircled by the heat-dissipating fins. In this way, the distance from the heat pipe to the distal end of the heat-dissipating fin is reduced.

Another characteristic of the present invention lies in that the cross section of the outer cylinder can be formed into any suitable shape, such as circle or polygon. Further, since the outer cylinder is a hollow cylinder, the air flows therethrough very smoothly. Thus, the efficiency in the heat dissipation is substantially increased.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

In order to make the Examiner better understand the characteristics and the technical contents of the present invention, the following detailed description will be made with reference to the accompanying drawings. However, it should be understood that the drawings are illustrative but not used to limit the scope of the present invention.

Figure 1:
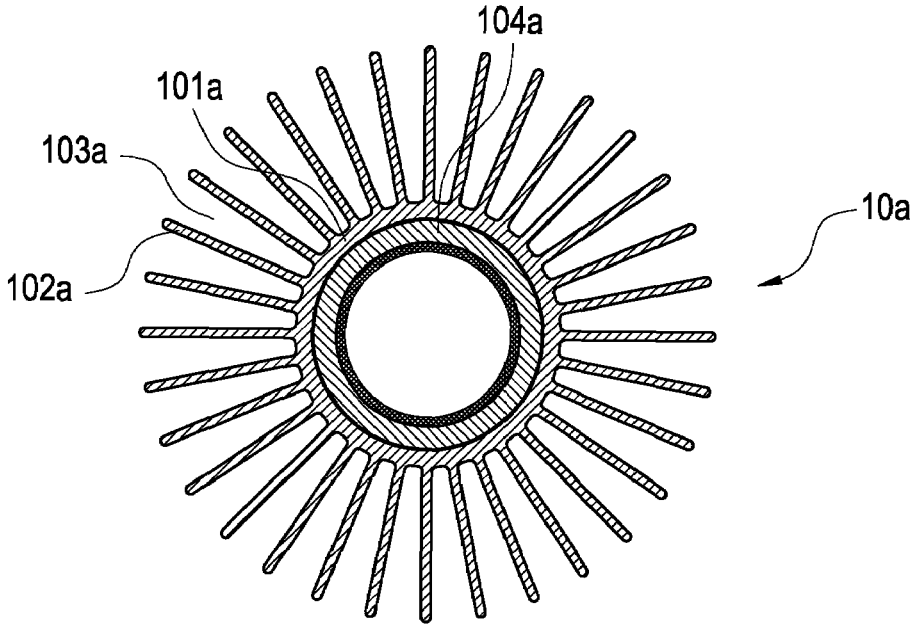
FIG.1 PRIOR ART
FIG. 1 is a cross-sectional top view of the conventional heat-dissipating device.
Figure 2:
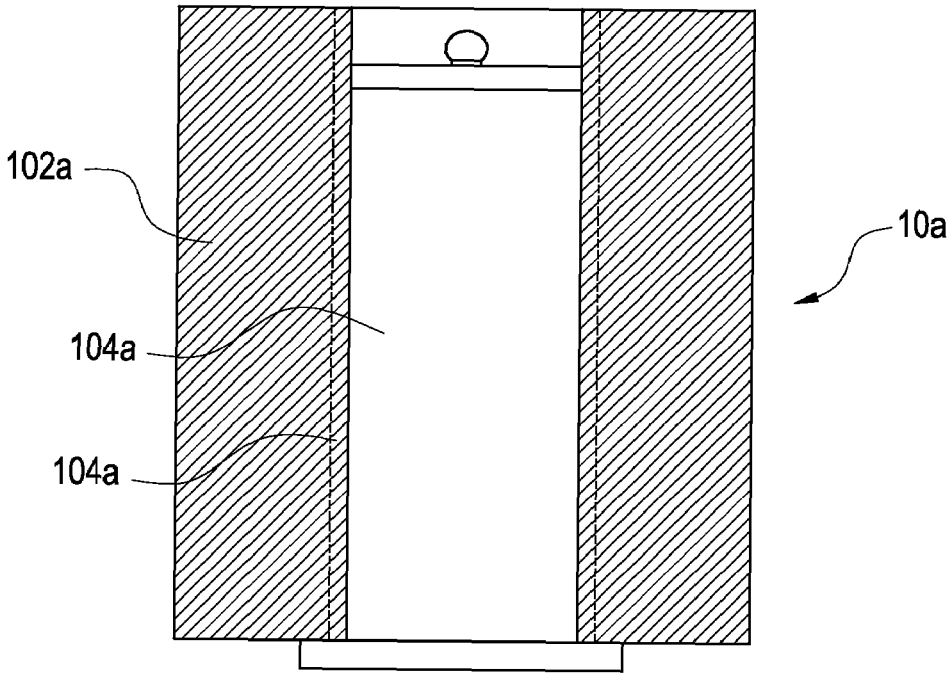
FIG.2 PRIOR ART
FIG. 2 is a cross-sectional side view of the conventional heat-dissipating device.
Figure 3:
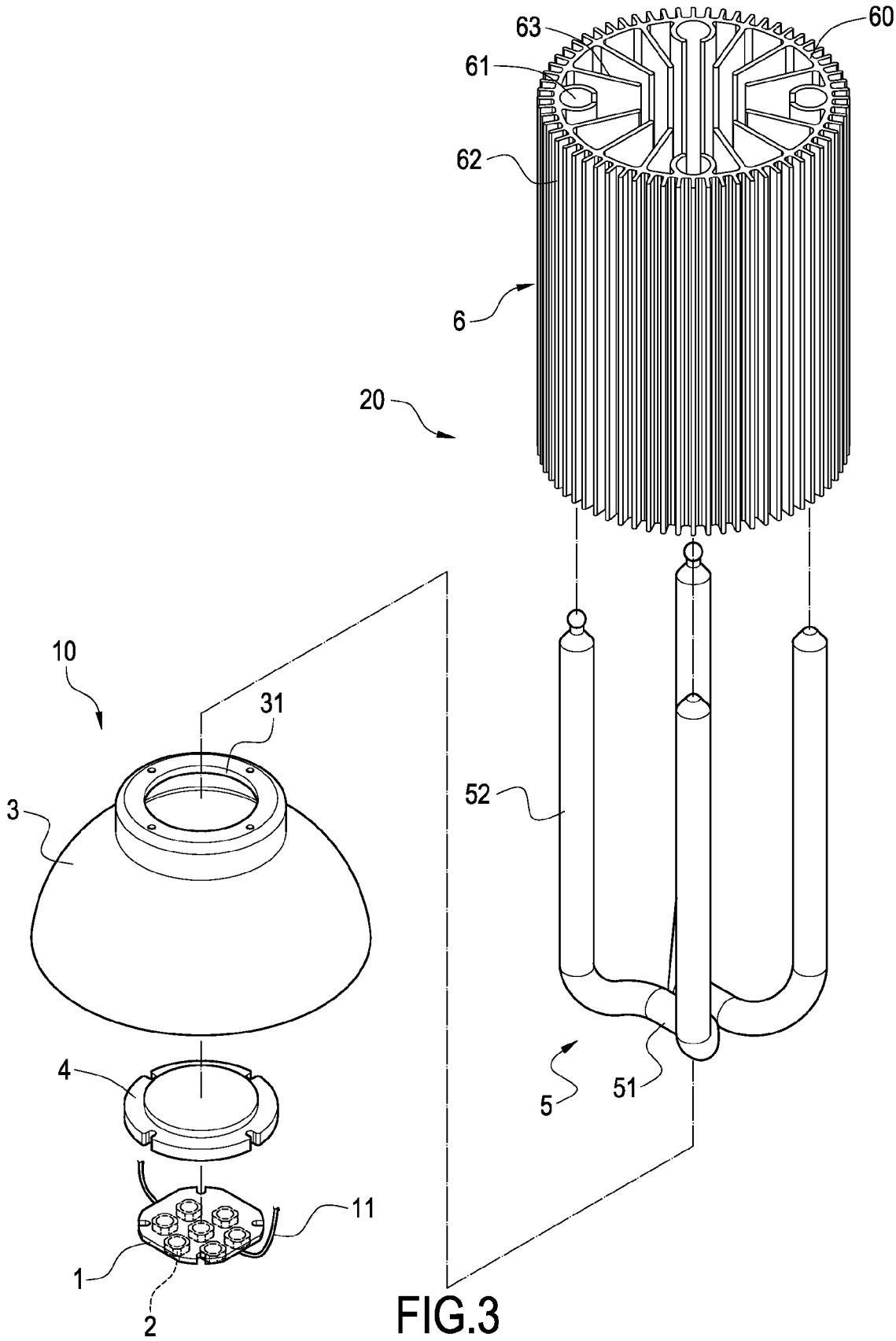
FIG. 3 is an exploded perspective view of the LED lamp and the heat-dissipating structure of the present invention.

The present invention is directed to a heat-dissipating structure for a LED lamp. With reference to FIG. 3, the LED lamp 10 comprises a base plate 1 for carrying a plurality of light-emitting diodes (LED) 2 thereon. Two electric power lines 11 are connected to the base plate 1. Further, the LED lamp is provided with a lamp cover 3 formed into a bowl-like shape. Thus, the base plate 1 carrying the LEDs 2 thereon and the heat-dissipating base 4 of the heat-dissipating structure 20 of the present invention are both fixed to the bottom end of the lamp cover 3. The two electric power lines 11 penetrate through the opening 31 of the bottom end of the lamp cover 3 and extend to the outside.

In the present invention, the heat-dissipating structure 20 comprises a heat-dissipating base 4 made of copper or aluminum. One surface of the heat-dissipating base 4 is adhered to the base plate 1 of the LED lamp 10, while the other surface thereof is exposed to the opening 31 of the bottom end of the lamp cover 3. Further, a plurality of heat pipes 5 are provided in the heat-dissipating structure of the present invention. In the first embodiment of the present invention, two heat pipes 5 formed into a U-lettered shape are provided. Each heat pipe 5 comprises a horizontal end 51 to be heated and two vertical condensed ends 52. The horizontal end 51 to be heated is fixed on the heat-dissipating base 4, while the vertical condensed ends 52 are inserted in the heat-dissipating body 6.

With reference to FIG. 3 again, the heat-dissipating body 6 has an outer cylinder 60 formed into a hollow cylinder. The inside face of the outer cylinder 60 is integrally provided with a plurality of axial accommodating grooves 61 made by aluminum extrusion. The condensed ends 52 of each heat pipe 5 are inserted into the accommodating grooves 61. The inside surface of the accommodating groove 61 is coated with a layer of heat-conducting medium for efficiently conducting the heat to the condensed ends 52 of the heat pipe 5. Further, the outside surface and the inside surface of the outer cylinder 60 are formed with a plurality of heat-dissipating fins 62 made by aluminum extrusion. In the present embodiment, the cross section of the outer cylinder 60 is formed into a circular shape. The outside surface of the outer cylinder 60 is formed with a plurality of short heat-dissipating fins 62 radially arranged at identical intervals and made by aluminum extrusion. The inside surface of the outer cylinder 60 is formed inwardly with a plurality of long heat-dissipating fins 63 radially arranged between the two accommodating grooves 61 and made by aluminum extrusion.

Figure 5:
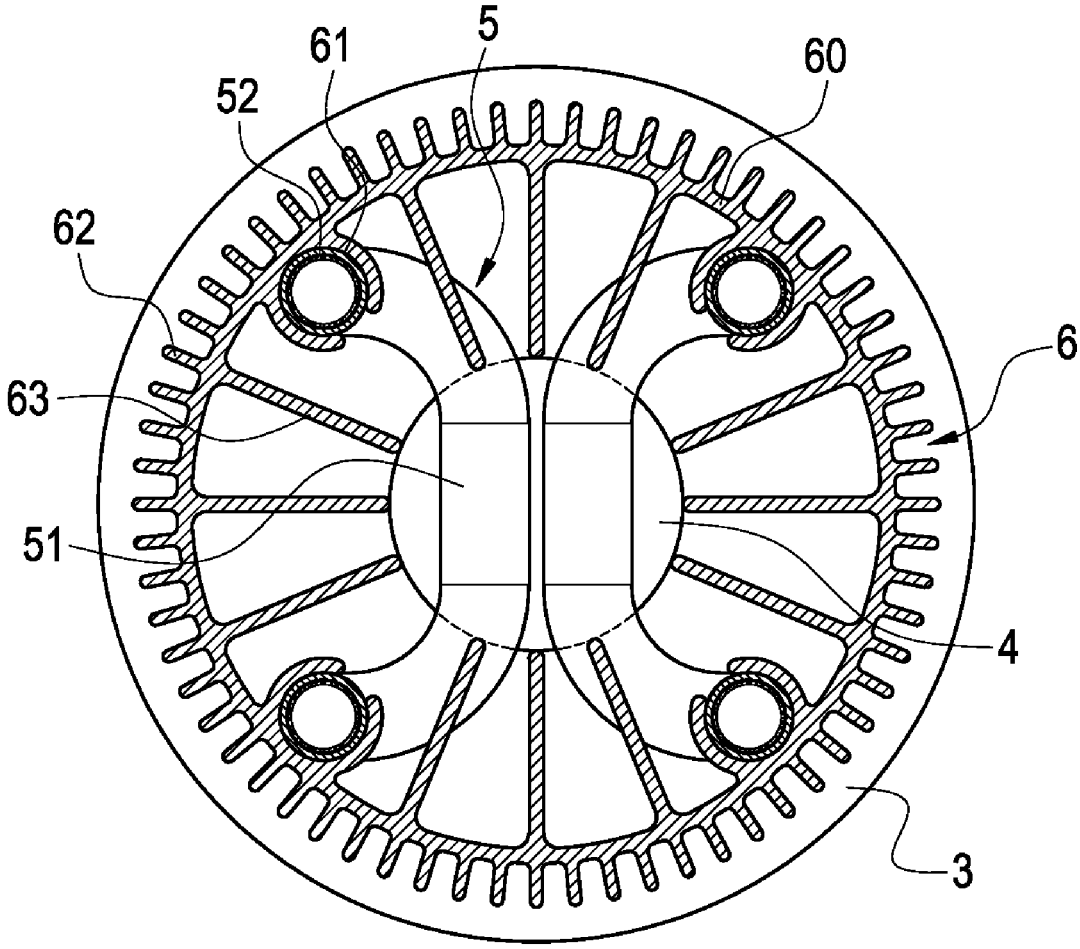
FIG. 5 is a cross-sectional view taken along the line 5-5 in FIG. 4.

Further, as shown in FIG. 5, the cross section of each accommodating groove 61 can be open.

Figure 7:
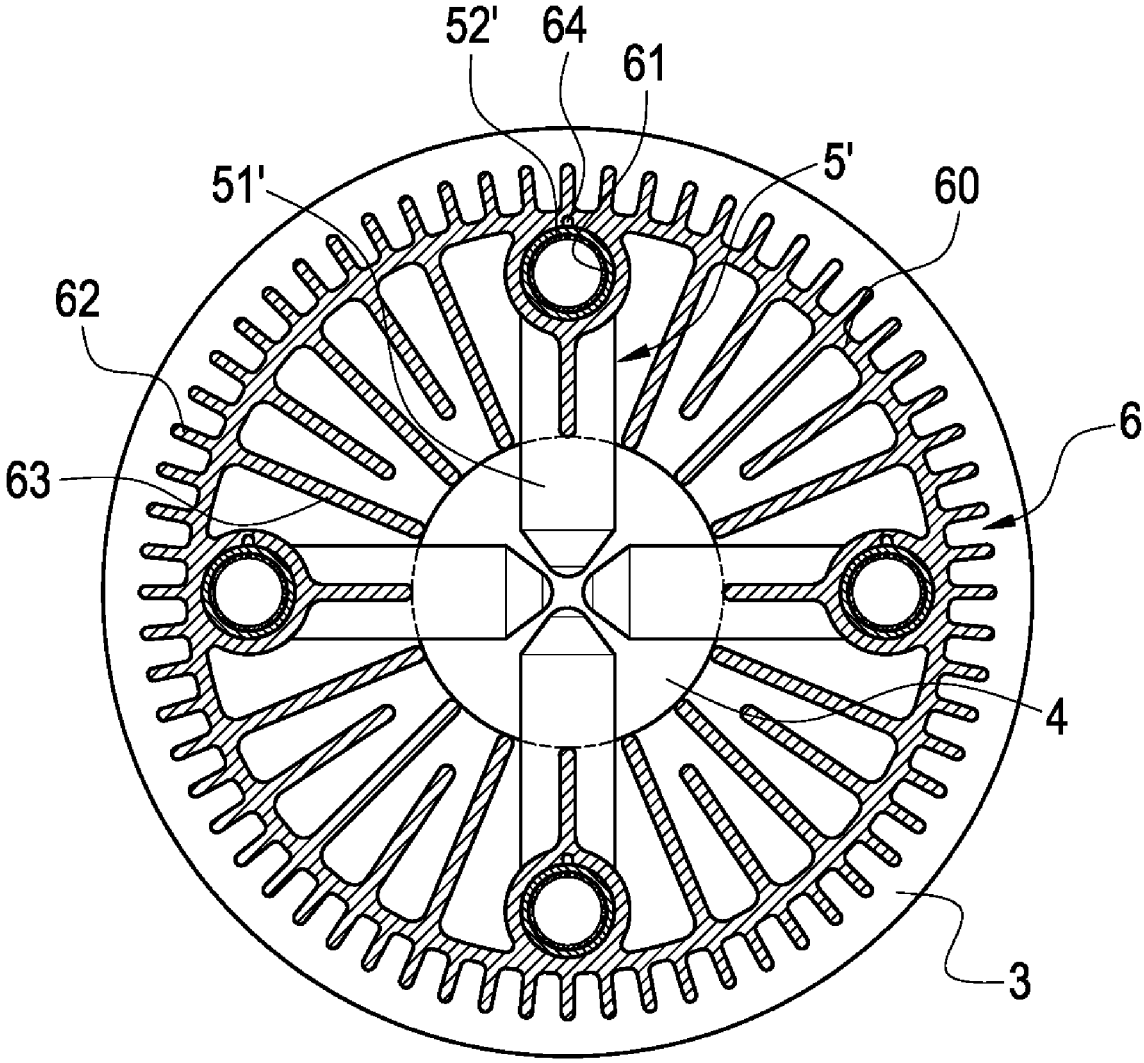
FIG. 7 is a cross-sectional view taken along the line 7-7 in FIG. 6.

That is, each accommodating groove 61 is communicated with the inner space of the outer cylinder 60. As shown in FIG. 7, the cross section of each accommodating groove 61 can be closed. That is, each accommodating groove 61 is not communicated with the inner space of the outer cylinder 60. Further, each accommodating groove 61 can be also provided with an aperture 64. Solders can be filled into the aperture 64 to facilitate the soldering.

Figure 4:
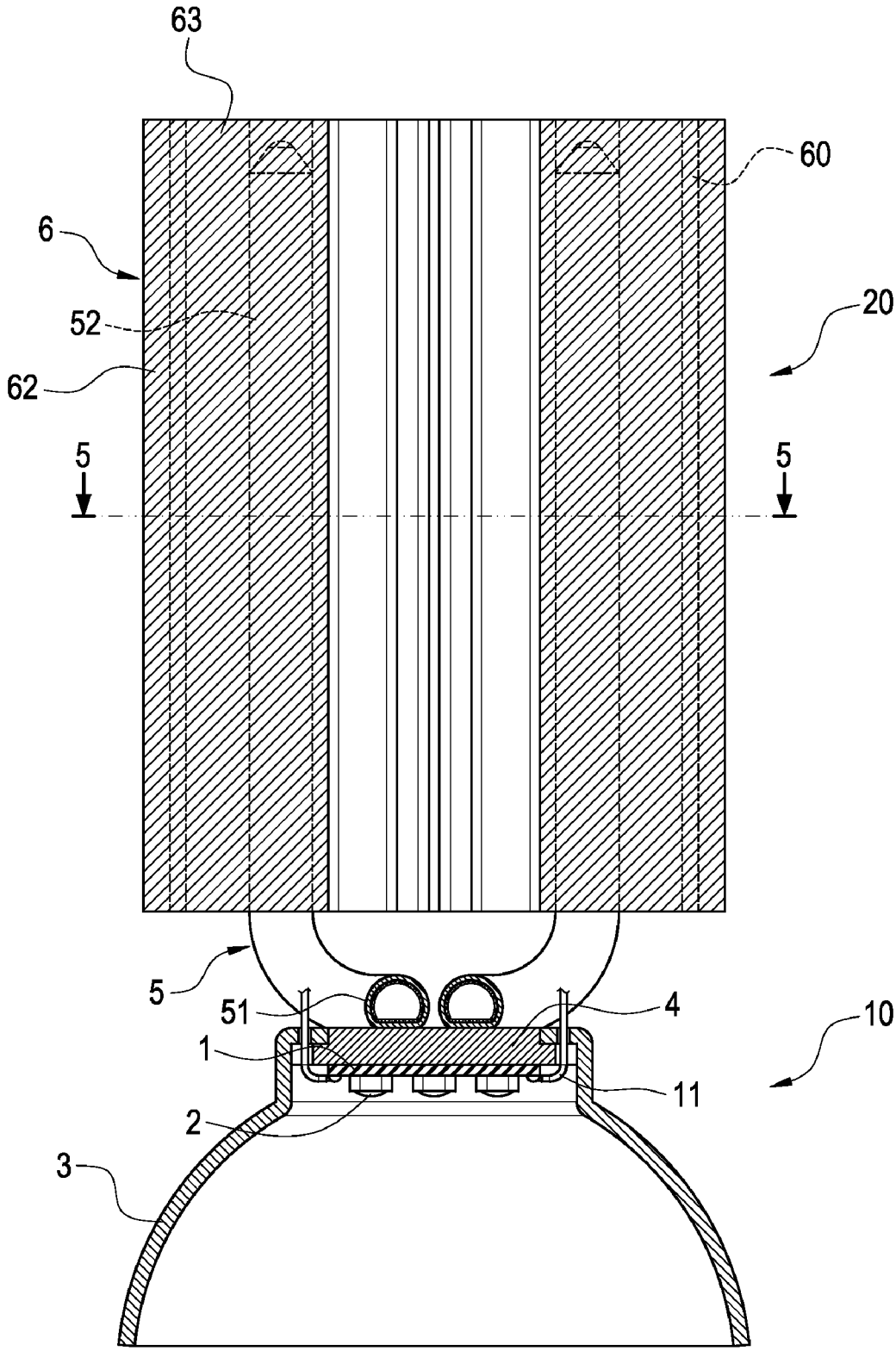
FIG. 4 is an assembled cross-sectional view of the LED lamp and the heat-dissipating structure of the present invention.

With reference to FIGS. 4 and 5, during the assembly of the present invention, the base plate 1 carrying the LEDs 2 thereon and the heat-dissipating base 4 are both fixed in the opening 31 of the bottom end of the lamp cover 3. The two electric power lines 11 provided on the base plate 1 penetrate through the lamp cover 3 and extend to the outside. The end 51 to be heated of the heat pipe 5 is adhered and fixed to the heat-dissipating base 4, while the condensed ends 52 of the heat pipe are inserted into the accommodating groove 61 of the heat-dissipating body 6. Thus, the heat pipes 5 are encircled by the heat-dissipating fins 62 and 63. Further, the distance between the heat pipe 5 and the distal end of the heat-dissipating fin 62 can be reduced.

Therefore, when the LED lamp 10 is in use, the heat generated by the LEDs is first conducted to the heat-dissipating base 4, and then sequentially conducted to each heat pipe 5 and the heat-dissipating fins 62, 63. Finally, the heat is dissipated to the outside by the heat-dissipating fins 62, 63.

Figure 6:
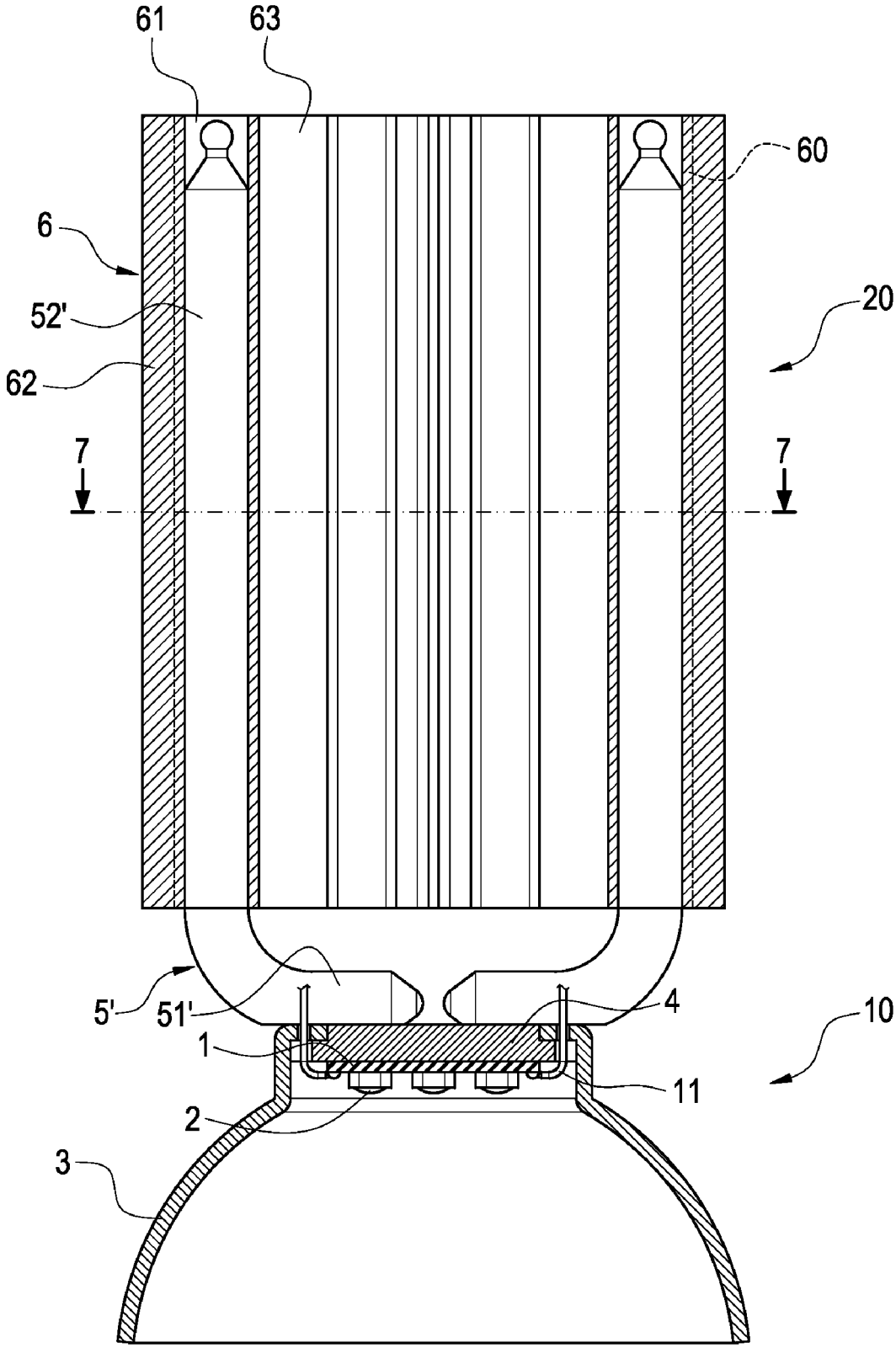
FIG. 6 is an exploded perspective view of the LED lamp and the heat-dissipating structure in accordance with a second embodiment of the present invention.
Figure 8:
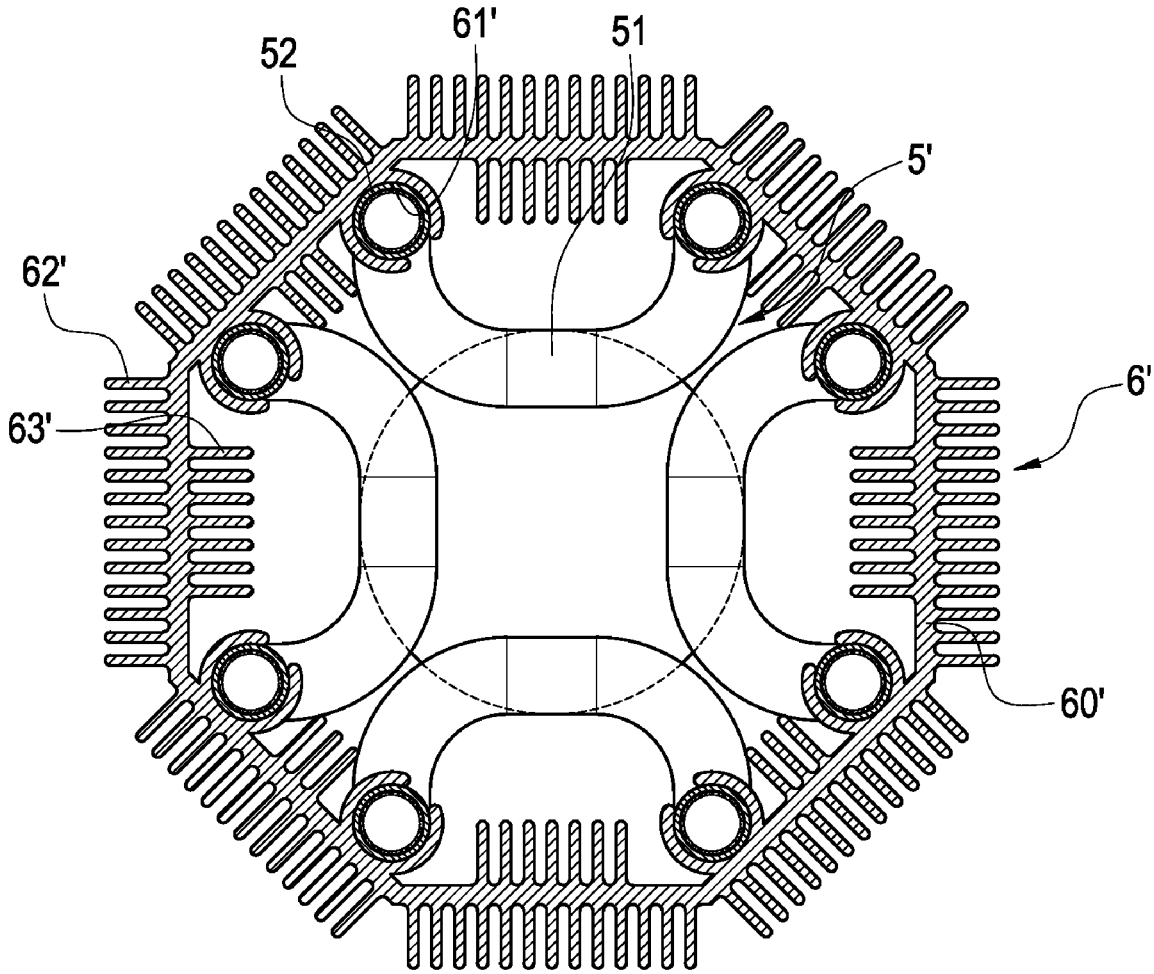
FIG. 8 is a cross-sectional top view of the LED lamp and the heat-dissipating structure in accordance with a third embodiment of the present invention.

FIG. 6 and FIG. 7 show the second embodiment of the present invention. The heat pipe 5' can be formed into a L-lettered shape and comprises a horizontal end 51' to be heated and a vertical condensed end 52'. Further, FIG. 8 shows the third embodiment of the present invention, in which the outer cylinder 60' of the heat-dissipating body 6' is formed into a polygon, such as a octagon in the present embodiment. Therefore, the inside surface and the outside surface of all the eight sides are provided with a plurality of heat-dissipating fins 62', 63' made by aluminum extrusion, eight accommodating grooves 61' and four U-shaped heat pipes 5. Each heat pipe 5 comprises a horizontal end 51 to be heated and two vertical condensed ends 52.

In the present invention, since the heat can be conducted by a plurality of heat pipes 5, so that the total contacting area is increased and the heat can be rapidly dissipated to the outer cylinder 60. Further, since the outer cylinder is a hollow cylinder, the air flows therethrough very smoothly so as to facilitate the speed of heat dissipation. Further, since the inside surface and the outside surface of the outer cylinder 60 are formed with the heat-dissipating fins 62, 63 made by aluminum extrusion, so that the distance between the heat pipe 5 and the distal end of the heat-dissipating fin 62 is reduced. Therefore, the heat can be rapidly dissipated to the outside and thus the efficiency in the heat dissipation of the whole heat-dissipating structure 20 can be substantially increased.

According to the above, the present invention indeed achieves the desired effects by employing the above-mentioned structure. Therefore, since the construction of the present invention has not been published or put to public use prior to applying for patent, the present invention involves the novelty and inventive steps, and conforms to the requirements for an invention patent.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A heat-dissipating structure for a light emitting diode (LED) lamp, the heat-dissipating structure being mounted on the LED lamp, comprising:

a heat-dissipating base for contacting with a heat source of the LED lamp;

a heat-dissipating body made by aluminum extrusion and positioned above the heat-dissipating base, the heat-dissipating body having an outer cylinder formed in a hollow cylinder, an inside surface of the outer cylinder being formed with a plurality of axial accommodating grooves, wherein an outside surface of the outer cylinder of the heat-dissipating body is formed outwardly with a plurality of shorter radial heat-dissipating fins, and the inside surface of the outer cylinder is formed inwardly between the axial accommodating grooves with a plurality of longer radial heat-dissipating fins; and a plurality of heat pipes, each heat pipe including a horizontal section to be heated and fixed on a surface of the heat-dissipating base and a straight condensed end vertically extended from the horizontal section to be inserted in the accommodating groove of the heat-dissipating body.

2. The heat-dissipating structure for a LED lamp according to claim 1, wherein a cross section of the outer cylinder of the heat-dissipating body is formed into a circle.

3. The heat-dissipating structure for a LED lamp according to claim 1, wherein a cross section of the outer cylinder of the heat-dissipating body is formed into a polygon.

4. The heat-dissipating structure for a LED lamp according to claim 1, wherein an inner surface of the accommodating groove is coated with a layer of heat-conducting medium.

5. The heat-dissipating structure for a LED lamp according to claim 1, wherein a cross section of the accommodating groove is open.

6. The heat-dissipating structure for a LED lamp according to claim 1, wherein a cross section of the accommodating groove is closed.

7. The heat-dissipating structure for a LED lamp according to claim 6, wherein the accommodating groove is provided with an aperture thereon.

8. The heat-dissipating structure for a LED lamp according to claim 1, wherein the heat pipe is formed into an U-lettered shape.

9. The heat-dissipating structure for a LED lamp according to claim 1, wherein the heat pipe is formed into a L-lettered shape.

* * * * *